US009217356B2

(12) United States Patent
Hodgson et al.

(10) Patent No.: US 9,217,356 B2
(45) Date of Patent: Dec. 22, 2015

(54) MOUNTING HAVING AT LEAST ONE ELECTRODE AND EXHAUST LINE DEVICE HAVING AT LEAST ONE MOUNTING

(71) Applicant: EMITEC GESELLSCHAFT FUER EMISSIONSTECHNOLOGIE MBH, Lohmar (DE)

(72) Inventors: Jan Hodgson, Troisdorf (DE); Christian Vorsmann, Cologne (DE)

(73) Assignee: EMITEC GESELLSCHAFT FUER EMISSIONSTECHNOLOGIE MBH, Lohmar (DE)

( * ) Notice: Subject to any disclaimer, the term of this patent is extended or adjusted under 35 U.S.C. 154(b) by 77 days.

(21) Appl. No.: 14/228,509

(22) Filed: Mar. 28, 2014

(65) Prior Publication Data

US 2014/0209201 A1 Jul. 31, 2014

Related U.S. Application Data

(63) Continuation of application No. PCT/EP2012/067359, filed on Sep. 6, 2012.

(30) Foreign Application Priority Data

Sep. 28, 2011 (DE) ..... 10 2011 115 228

(51) Int. Cl.

| | |
|---|---|
| ***B01D 50/00*** | (2006.01) |
| ***F01N 13/00*** | (2010.01) |
| ***F01N 3/01*** | (2006.01) |
| ***F01N 3/027*** | (2006.01) |

(52) U.S. Cl.

CPC ..... *F01N 13/008* (2013.01); *F01N 3/01* (2013.01); *F01N 3/0275* (2013.01); *F01N 2240/28* (2013.01)

(58) Field of Classification Search

CPC ..... F01N 13/008; F01N 3/01; F01N 3/0275; F01N 2240/28

See application file for complete search history.

(56) References Cited

U.S. PATENT DOCUMENTS

| | | | | | |
|---|---|---|---|---|---|
| 2,960,620 | A | * | 11/1960 | Stoeckert | 313/317 |
| 3,140,418 | A | * | 7/1964 | Knauf, Jr. | 313/266 |
| 4,056,372 | A | * | 11/1977 | Hayashi | 96/87 |

(Continued)

FOREIGN PATENT DOCUMENTS

| | | | |
|---|---|---|---|
| DE | 461306 | C | 6/1928 |
| DE | 497081 | C | 5/1930 |

(Continued)

*Primary Examiner* — Amber Orlando

(74) *Attorney, Agent, or Firm* — Laurence Greenberg; Werner Stemer; Ralph Locher

(57) ABSTRACT

A mounting includes at least one electrode producing electric fields in an exhaust gas line, a disk of electrically insulating material having inflow and outflow sides and openings for exhaust gas, and at least one electrical conductor fastened to and/or in the disk. The electrical conductor is covered by the electrically insulating material at least on the inflow side and in electrical contact with the electrodes extending toward the outflow side. Since the electrical conductor is completely surrounded by insulating material during operation, an area that must be covered by a soot layer for a leakage current to develop is increased. The leakage length increases and one or more electrodes are in the exhaust gas at the same time. The soot particles deposited on the mounting and the exhaust gas line, need to be removed less often. An exhaust line device having at least one mounting is also provided.

12 Claims, 4 Drawing Sheets

(56) References Cited

U.S. PATENT DOCUMENTS

| | | | | |
|---|---|---|---|---|
| 4,282,267 | A * | 8/1981 | Kuyel | 427/568 |
| 5,068,884 | A * | 11/1991 | Choe et al. | 378/119 |
| 5,950,424 | A * | 9/1999 | Nojima | 60/275 |
| 6,077,334 | A | 6/2000 | Jaonnou | |
| 6,506,238 | B1 * | 1/2003 | Endo | 96/79 |
| 6,716,404 | B2 * | 4/2004 | Masaki et al. | 423/213.2 |
| 6,735,830 | B1 | 5/2004 | Merciel | |
| 6,886,328 | B2 * | 5/2005 | Kinoshita | 60/275 |
| 6,994,076 | B2 | 2/2006 | Heckel et al. | |
| 7,120,007 | B2 | 10/2006 | Nakasone et al. | |
| 7,785,403 | B2 * | 8/2010 | Ouyang et al. | 96/18 |
| 2010/0294129 | A1 * | 11/2010 | Op de Laak et al. | 95/79 |
| 2011/0072786 | A1 | 3/2011 | Tokuda et al. | |
| 2011/0115362 | A1 | 5/2011 | Sekoguchi | |

FOREIGN PATENT DOCUMENTS

| | | | |
|---|---|---|---|
| DE | 102005013184 | A1 | 10/2005 |
| DE | 602004007072 | T2 | 9/2007 |
| DE | 60034040 | T2 | 8/2008 |
| EP | 2305976 | A2 | 4/2011 |
| JP | 2005240634 | A | 9/2005 |
| JP | 2006026483 | A | 2/2006 |
| JP | 2006026486 | A | 2/2006 |
| JP | 2006342730 | A | 12/2006 |
| JP | 2011069268 | A | 4/2011 |
| WO | 9525598 | A1 | 9/1995 |

* cited by examiner

MOUNTING HAVING AT LEAST ONE ELECTRODE AND EXHAUST LINE DEVICE HAVING AT LEAST ONE MOUNTING

CROSS-REFERENCE TO RELATED APPLICATION

This is a continuation, under 35 U.S.C. §120, of copending International Application No. PCT/EP2012/067359, filed Sep. 6, 2012, which designated the United States; this application also claims the priority, under 35 U.S.C. §119, of German Patent Application DE 10 2011 115 228.1, filed Sep. 28, 2011; the prior applications are herewith incorporated by reference in their entirety.

BACKGROUND OF THE INVENTION

Field of the Invention

The present invention relates to a mounting or retainer having at least one electrode for generating electric fields in an exhaust line. The invention also relates to an exhaust line device having at least one mounting.

In motor vehicles with mobile internal combustion engines, and in particular in diesel-driven motor vehicles, the exhaust gas of the internal combustion engine generally contains quantities of soot particles which must not be discharged into the atmosphere. That is predefined by corresponding exhaust-gas regulations which specify limit values for the number and mass of soot particles per unit weight of exhaust gas or per unit volume of exhaust gas and sometimes also for an overall motor vehicle. Soot particles are, in particular, unburned carbons and hydrocarbons in the exhaust gas.

Numerous different concepts for eliminating soot particles from exhaust gases of mobile internal combustion engines have already been discussed. Aside from alternately closed-off wall-flow filters, open bypass flow filters, gravity-driven separators etc., systems have also already been proposed in which the particles in the exhaust gas are electrically charged and then deposited with the aid of electrostatic attraction forces. Those systems are known, in particular, under the name "electrostatic filters" or "electro filters."

In the case of "electro filters," an agglomeration of small soot particles to form larger soot particles and/or electrical charging of soot particles are effected through the provision of an electric field and/or a plasma. Electrically charged soot particles and/or relatively large soot particles are generally much easier to separate out in a filter system. Soot particle agglomerates, due to their relatively high mass inertia, are transported more inertly in an exhaust-gas flow and thus accumulate more easily at diversion points of an exhaust-gas flow. Electrically charged soot particles, due to their charge, are drawn towards surfaces on which they accumulate and dissipate their charge. That, too, facilitates the removal of soot particles from the exhaust-gas flow during the operation of motor vehicles.

For such electrofilters, it has thus already been proposed to use multiple emission electrodes and collector electrodes which are positioned in the exhaust line. In that case, for example, a central emission electrode which extends approximately centrally through the exhaust line, and a surrounding lateral surface of the exhaust line as a collector electrode, are utilized to form a capacitor. With that configuration of emission electrode and collector electrode, an electric field is generated transversely with respect to the flow direction of the exhaust gas, wherein the emission electrode may be operated, for example, with a high voltage which lies in the range of approximately 15 kV [15,000 volts]. In this way, it is possible in particular for corona discharges to be generated through which the particles flowing with the exhaust gas through the electric field are subjected to a unipolar charge. Due to the charging, the particles travel, as a result of the electrostatic Coulomb forces, to the collector electrode.

Aside from systems in which the exhaust line is used as a collector electrode, systems are also known in which the collector electrode is, for example, in the form of a wire grate. In that case, the deposition of particles on the wire grate takes place for the purpose of bringing the particles together with further particles if appropriate, in order to thereby realize an agglomeration. The exhaust gas which flows through the grate then entrains the relatively large particles again and conducts them to classic filter systems.

In the case of the configuration of emission electrode and collector electrode one behind the other in the exhaust line, it is desirable for a plurality of electrodes to be distributed over the cross section of the exhaust line, in such a way that a uniformly distributed electric field, or an electric field that is adjustable over the cross section of the exhaust line, is generated. However, the problem is often encountered that, due to deposited soot particles on the electrode and on the mounting thereof, creepage currents occur between the electrode and the exhaust line, which is at a different electrical potential. The creepage currents lead, for example, to charging of the exhaust line, and should be prevented. It is known that soot which has been deposited on the electrode and on the mounting can be eliminated at regular intervals by regeneration, in particular by a catalytically assisted regeneration and by brief heating of the exhaust gases. In order to ensure that complete regeneration of the deposited soot on the electrodes and on the mounting thereof only has to be performed at long time intervals, it is desirable for creepage currents to be prevented, or kept low, for as great a length of time as possible.

It must also be taken into consideration that, for the provision of such components for a soot separation system, use should be made of components which are as simple as possible, in particular also components which can be produced inexpensively by mass production.

SUMMARY OF THE INVENTION

It is accordingly an object of the invention to provide a mounting having at least one electrode and an exhaust line device having at least one mounting, which overcome the hereinafore-mentioned disadvantages and at least partially solve the highlighted problems of the heretofore-known mountings and devices of this general type. In particular, it is sought to specify a mounting having one or a plurality of electrodes, in which as far as possible no creepage currents, or only very low creepage currents, occur.

With the foregoing and other objects in view there is provided, in accordance with the invention, a mounting, comprising one or a plurality of electrodes for generating electric fields in an exhaust line, a disk which is composed of an electrically insulating material and has an inflow side, an outflow side and openings through which an exhaust gas can flow from the inflow side to the outflow side, and at least one electrical conductor fastened on and/or in the disk. The electrical conductor, at least on the inflow side of the disk, is covered by the electrically insulating material and is in electrical contact with the one or plurality of electrode(s) that extend(s) toward the outflow side.

The mounting is, in particular, constructed in such a way that it can be disposed in the exhaust line of an internal combustion engine. It is preferable for at least 3, particular preferably even at least 10 electrodes to be fastened to the mounting. In the installed state, the exhaust gas of the internal combustion engine flows through the exhaust line and the mounting, wherein that side of the mounting which faces toward the internal combustion engine forms the inflow side, and the opposite side in the flow direction forms the outflow side of the mounting.

Within the context of the present invention, a disk is to be understood to mean a body having dimensions transversely with respect to the flow direction which are significantly greater than its dimensions in the flow direction. It is preferable for a maximum length of the disk transversely with respect to the flow direction to be at least three times as great as a maximum length of the disk in the flow direction. In particular, in the disk, passages for the exhaust gas are formed which extend substantially in the disk from the inflow side to the outflow side and thus form the openings through which a flow can pass. The disk is, in particular, formed from an electrically insulating material, in particular from a ceramic.

An electrical conductor, which is fastened on and/or in the disk, can connect the one or plurality of electrodes in electrically conductive fashion to a voltage source. In particular, the electrical conductor is composed of a metallic wire or of a punched metallic sheet. The electrical conductor is covered, on the inflow side, by the electrically insulating material, which means in particular that the electrically insulating metal completely covers the electrical conductor in the flow direction of the exhaust gas, in such a way that no exhaust gas can impinge directly on the electrical conductor.

During operation, the exhaust gas flowing in the exhaust line passes through the mounting through the openings, wherein the soot particles contained in the exhaust gas are subsequently ionized by a corona or plasma discharge at the tip of the electrode(s). By virtue of the fact that the electrical conductor is covered, on the inflow side, by the electrical material, no soot particles are deposited on the electrical conductor on the inflow side. Any deposition of the soot particles on the inflow side takes place at most on the electrically insulating material. The surface area that has to be covered by a soot layer in order to enable a creepage current to form from the one or more electrode(s) to the exhaust line, is increased considerably by the invention, whereby the probability of the formation of a creepage current is reduced. The length of the path of the creepage current is also referred to as creepage length, which is increased by the invention.

In accordance with another advantageous feature of the invention, the electrical conductor has an electrically insulated elongation for being led through a wall of the exhaust line. By way of the electrically insulated elongation of the electrical conductor, the electrical conductor can be connected, from outside the exhaust line, to a voltage source, and the electrical conductor is preferably surrounded, at the point at which it is led through the wall, by the electrically insulating material.

In accordance with a further preferable feature of the invention, the electrical conductor is fastened in at least one groove in the disk. A groove is a depression in the disk, which is formed in the disk, in particular, on the outflow side. The electrical conductor thus remains covered by the electrically insulating material on the inflow side. This also has the advantage that the exhaust gas does not impinge on the electrical conductor at its sides during operation, so that soot particles can be deposited on the electrical conductor only on the outflow side. In this way, the surface area that has to be covered by soot in order to ensure that a creepage current can form between the electrical conductor and exhaust line is enlarged further.

In accordance with an added preferable feature of the invention, the electrical conductor is fastened on and/or in the disk by a connecting material, in particular by a high-temperature silicone, a high-temperature adhesive or a high-temperature paste. The connecting material is, in particular, suitable for compensating for the different coefficients of thermal expansion of the electrically insulating material and of the electrical conductor. Thus, the electrical conductor is fixedly connected to the disk, but stresses cannot arise therebetween to such an extent as to destroy the fastening between them.

In accordance with an additional preferred feature of the invention, the mounting has a cover which is disposed on the outflow side of the disk, and the cover has cutouts for receiving the electrode(s). The cover is preferably likewise produced from the electrically insulating material. It is preferable for the disk and the cover to completely enclose the electrical conductor. The electrical conductor is thus preferably surrounded by the electrically insulating material on all sides, in such a way that no soot particles can be deposited on the electrical conductor. A deposition of soot particles can take place at most on the one or more electrodes. It is pointed out that the electrical conductor is to be understood, in particular, to mean those electrically conductive materials which are situated, in or on the disk, substantially transversely with respect to the flow direction. Sections of an electrical conductor which extend in the flow direction are instead assigned to the electrode.

In accordance with yet another feature of the invention, the cover may be connected to the disk by force-locking, form-locking and/or material connection. In order to produce a material connection, it is possible for the disk to initially be provided with the electrical conductor, and for the cover to subsequently be cast onto the disk, wherein openings already provided in the disk are generated by corresponding templates in the cover. The cover has openings congruent with those in the disk, and also has the cutouts through which the electrodes project. In this case, the electrodes are connected to the electrical conductor within the electrically insulating material.

Alternatively, the disk may initially be provided with the electrical conductors, and the prefabricated cover is subsequently pushed from the outflow side onto the disk with the electrical conductors. In this case, in particular, openings are provided in the cover which are congruent with the openings in the disk, and cutouts are also provided through which the electrodes can project.

In accordance with yet a further preferable feature of the invention, a projection extends from the cover around the cutout in the direction of the flow direction, in such a way that the electrode, too, is to a significant extent surrounded by the cover proceeding from the electrical conductor. In this way, the creepage length is increased further.

In accordance with yet an added advantageous feature of the invention, the one or plurality of electrodes and the electrical conductor are connected to one another by form-locking, force-locking and/or material connection.

In the case of form-locking, the spatial form of the electrode(s) and of the electrical conductor and the configuration thereof relative to one another prevents a relative movement thereof with respect one another. In the case of force-locking, a force acts on the two elements, which force prevents a movement of the elements relative to one another. In the case of material connection, the elements are connected to one another due to molecular bonds between the elements. Material connection may be produced, for example, by virtue of the electrode(s) being welded to the electrical conductor. Force-locking is generated, for example, by virtue of the electrode(s) being pushed into a cutout of the cover, in such a way that the cover holds the electrode(s) in electrical contact with the electrical conductor.

In accordance with yet an additional preferable feature of the invention, the disk has a pot-shaped form, with an outer region that projects toward the outflow side. The projecting outer region thus extends toward the outflow side in the same direction as the electrodes, and in so doing covers the inner surface of the wall of the exhaust line. In this case, the outer region is, in particular, in contact with the inner surface of the wall of the exhaust line. This, too, further enlarges the surface area that has to be covered by soot in order to ensure that a creepage current can form between the electrodes and exhaust line wall.

In accordance with again another preferable feature of the invention, the projecting outer region extends along the exhaust line beyond at least one electrode. This means that the length of the outer region in the flow direction proceeding from the disk is longer than the length of an electrode in the flow direction proceeding from the disk. It is achieved in this way that no spark discharges can form between the electrode and the wall of the exhaust line transversely with respect to the flow direction.

In accordance with again a further preferred feature of the invention, the disk can be installed into the exhaust line in an approximately transverse configuration and substantially completely spans a cross section of the exhaust line. It is thus necessary for all of the exhaust gas to flow through the mounting. In this way, it is also ensured that all of the exhaust gas flows around the electrodes.

In accordance with again an added advantageous feature of the invention, the disk has at least one first and one second electrical conductor which are electrically insulated from one another, wherein a first group and a second group of electrodes are in each case in electrical contact with one of the electrical conductors. Thus, at least two electrical conductors are fastened in the disk, through which electrical conductors in each case one group of electrodes can be connected to a high-voltage unit. In this way, the electrodes can be charged with different potentials in such a way that the electric field can be adapted, in a locally distributed manner over the cross section of the exhaust line, to different exhaust line geometries, flow profiles or exhaust-gas compositions.

With the objects of the invention in view, there is also provided a device in an exhaust line for the ionization of soot particles in the exhaust gas of an internal combustion engine, comprising at least one mounting according to the invention and a particle separator disposed downstream in the flow direction. The device also includes, in particular, a voltage source, which is connected through the electrical conductor to the electrodes, and a counter electrode for generating an electric field between the electrodes and the counter electrode. Thus, a device is specified which firstly ionizes the particles contained in the exhaust gas, and the ionized soot particles are deposited in the particle separator.

In accordance with another preferable feature of the invention, the particle separator forms a counter electrode. Thus, the particle separator has a dual function in that it separates off the ionized particles and simultaneously contributes to the generation and/or form of the electric field.

The invention can be used, in particular, in the automotive sector, for example in a motor vehicle which has an internal combustion engine with an exhaust system, wherein the exhaust system has at least one device of the type according to the invention.

Other features which are considered as characteristic for the invention are set forth in the appended claims, noting that the features specified individually in the claims may be combined with one another in any desired technologically expedient manner and form further embodiments of the invention.

Although the invention is illustrated and described herein as embodied in a mounting having at least one electrode and an exhaust line device having at least one mounting, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
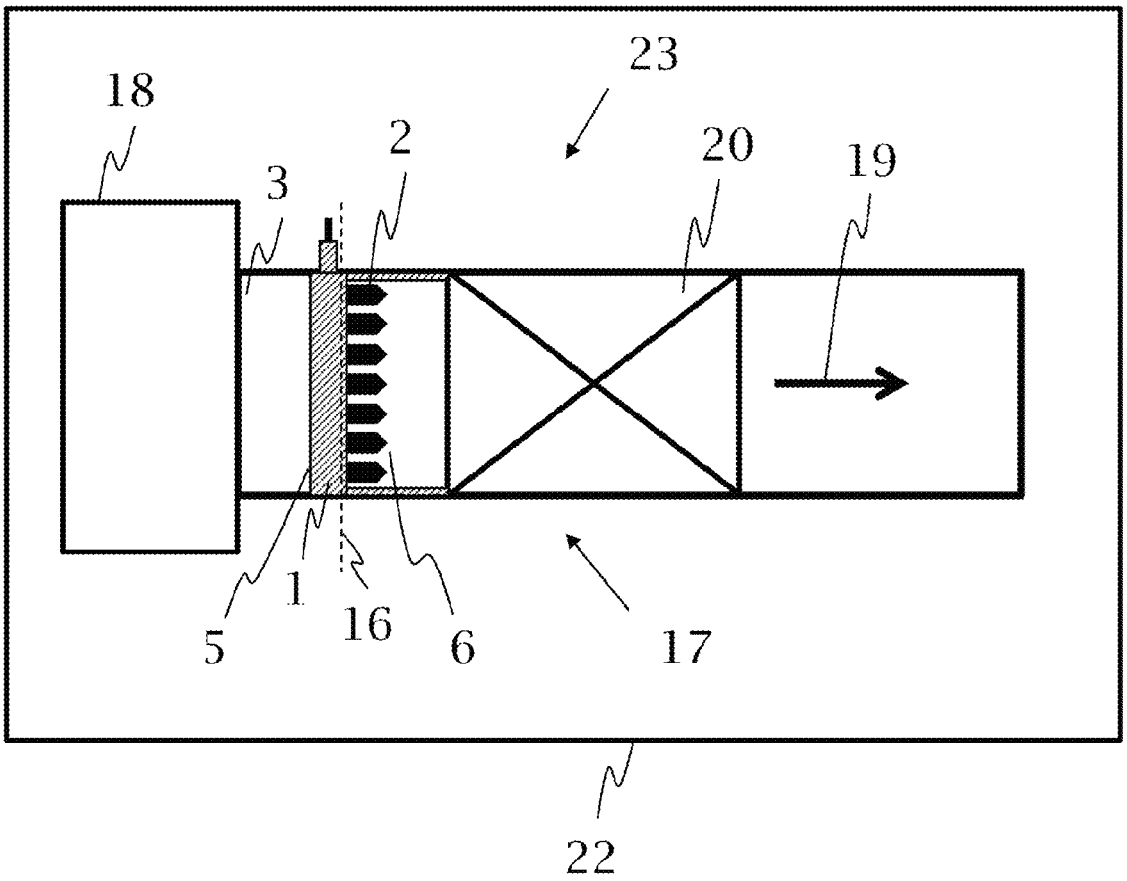
FIG. 1 is a diagrammatic, partly-sectional, plan view of a motor vehicle having an embodiment of a mounting according to the invention.

Referring now in detail to the figures of the drawings which show particularly preferred embodiments to which the invention is not restricted and first, particularly, to FIG. 1 thereof, there is seen a diagrammatically illustrated motor vehicle 22 having an internal combustion engine 18 and an exhaust system 23 connected to the internal combustion engine. The exhaust system 23 includes an exhaust line 3 in which there is provided an embodiment of a device 17 having a mounting 1 according to the invention with electrodes 2. Exhaust gas flows through the mounting 1 in a flow direction 19 from an inflow side 5 to an outflow side 6. A particle separator 20, which is disposed in the exhaust line 3 downstream of the mounting 1 in the flow direction 19, belongs to the device 17. During operation, exhaust gas which flows from the internal combustion engine 18 and contains soot particles, flows initially through openings of the mounting 1 and enters the region or vicinity of the electrodes 2. There, the soot particles are ionized by a corona or plasma discharge at the tips of the electrodes 2, and the ionized soot particles are deposited in the particle separator 20.

An embodiment of the mounting will be explained in more detail below on the basis of FIGS. 2 to 4.

Figure 2:
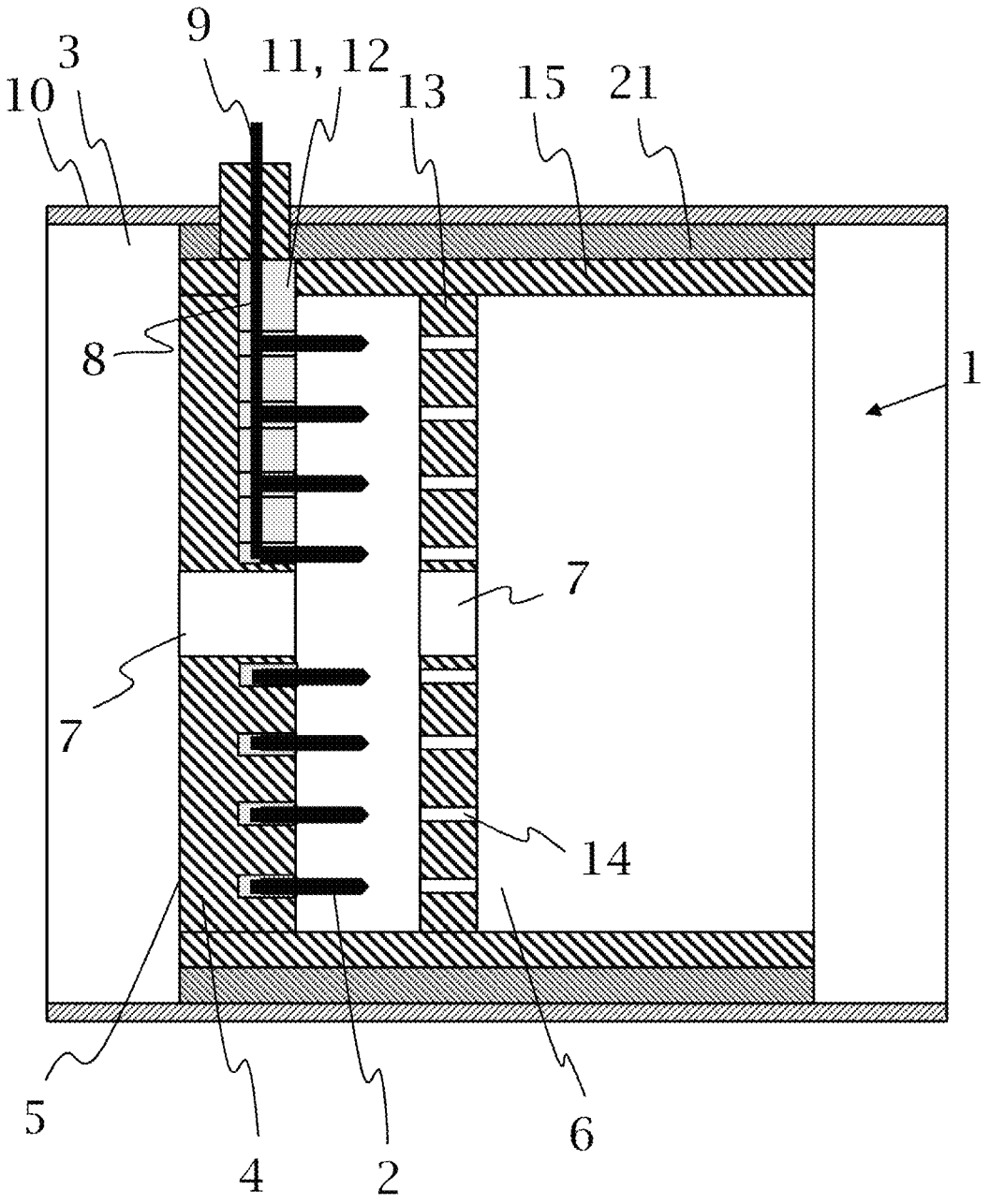
FIG. 2 is an enlarged, longitudinal-sectional view of an exhaust line having an embodiment of the mounting according to the invention.

FIG. 2 diagrammatically shows a longitudinal section through an embodiment of a mounting 1, in an exhaust line 3 which is delimited by a wall 10. The mounting 1 is fastened in the exhaust line 3 by a swellable mat 21. The mounting 1 includes a disk 4 with openings 7 which extend from the inflow side 5 to the outflow side 6. An electrical conductor 8, which is fastened in the disk 4, is connected in electrically conductive fashion to the electrodes 2. The disk 4, which is manufactured from an electrically insulating material, completely covers the electrical conductor 8 on the inflow side 5. The electrical conductor 8 is situated in a groove 11 of the disk 4 and is fastened there by a connecting material 12. The electrical conductor 8 furthermore has an elongation 9 which is surrounded by electrically insulating material and which extends through the wall 10 of the exhaust line 3. There, the electrical conductor 8 can be connected to a voltage source.

The mounting 1 also has an outer region 15 composed of the electrically insulating material. The outer region 15 extends, in contact with the wall 10 of the exhaust line 3, in the flow direction 19 on the outflow side 6. The mounting 1 also includes a cover 13 which, in this case, is illustrated separately from the disk 4 but which, during operation, is pushed onto and fixed to the disk 4. The cover 13 has cutouts 14 through which the electrodes 2 project. Furthermore, the cover 13 has openings 7 which, in the assembled state, are congruent with the openings 7 of the disk 4. A cross section 16 through the exhaust line 3 will be explained in more detail with reference to FIG. 3.

Figure 3:
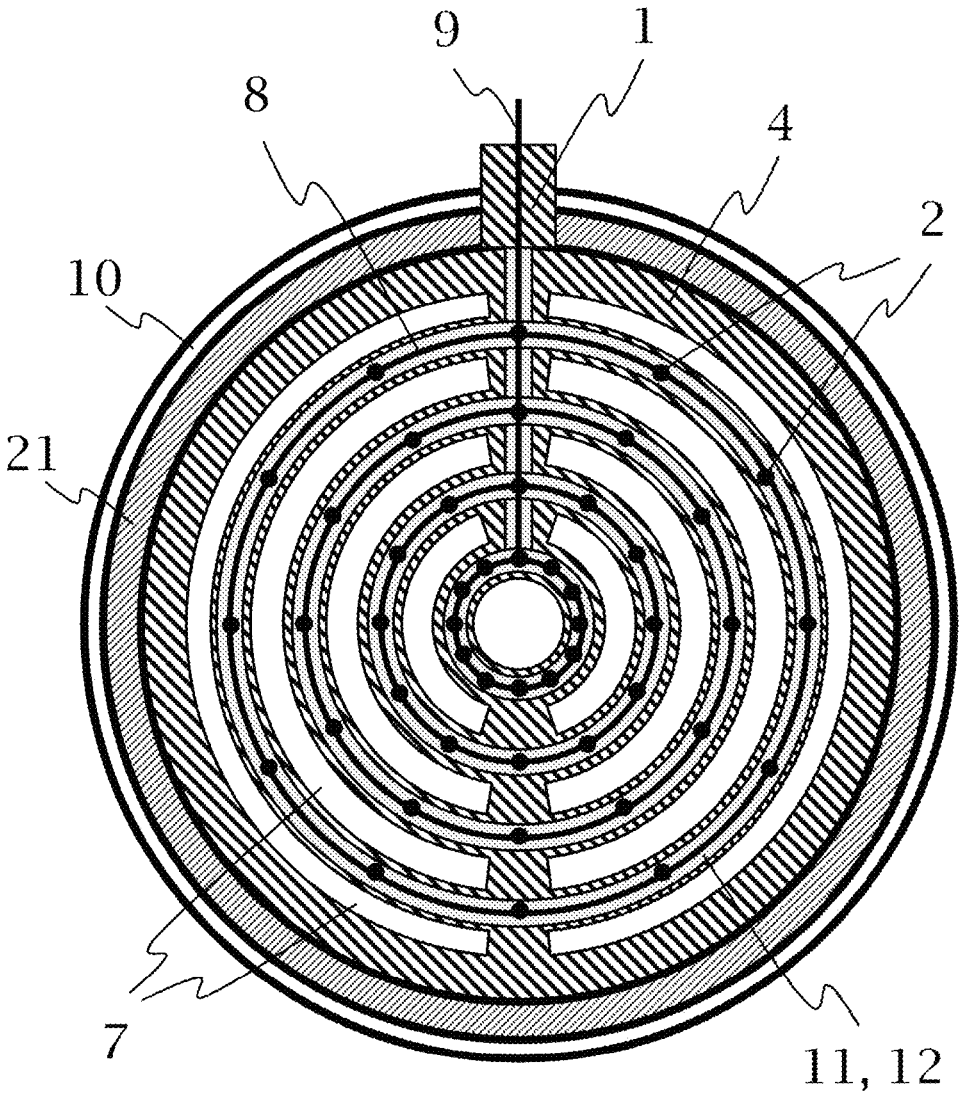
FIG. 3 is a cross-sectional view of an embodiment of the mounting according to the invention.

FIG. 3 shows the cross section 16 through the mounting of FIG. 2. The disk 4 is connected to the wall 10 of the exhaust line 3 by the swellable mat 21. The disk 4 has the openings 7 through which the exhaust gas of the internal combustion engine 18 flows during operation. The electrical conductor 8 is fastened in the grooves 11 formed in the disk 4 by using the connecting material 12. The electrodes 2 are fastened in electrically conductive fashion to the electrical conductor 8. The electrical conductor 8 also has the elongation 9 which projects through the wall 10 of the exhaust line, in such a way that the elongation 9 is surrounded by an electrically insulating material. The electrical conductor 8 may be seen to include at least first and second electrical conductors 8 being electrically insulated from one another, and the electrodes 2 may be seen to include a first group and a second group of electrodes 2 each being in electrical contact with a respective one of the first and second electrical conductors 8. Therefore, the electrodes can be charged with different potentials for adapting the electric field, in a locally distributed manner over the cross section of the exhaust line, to different exhaust line geometries, flow profiles or exhaust-gas compositions.

Figure 4:
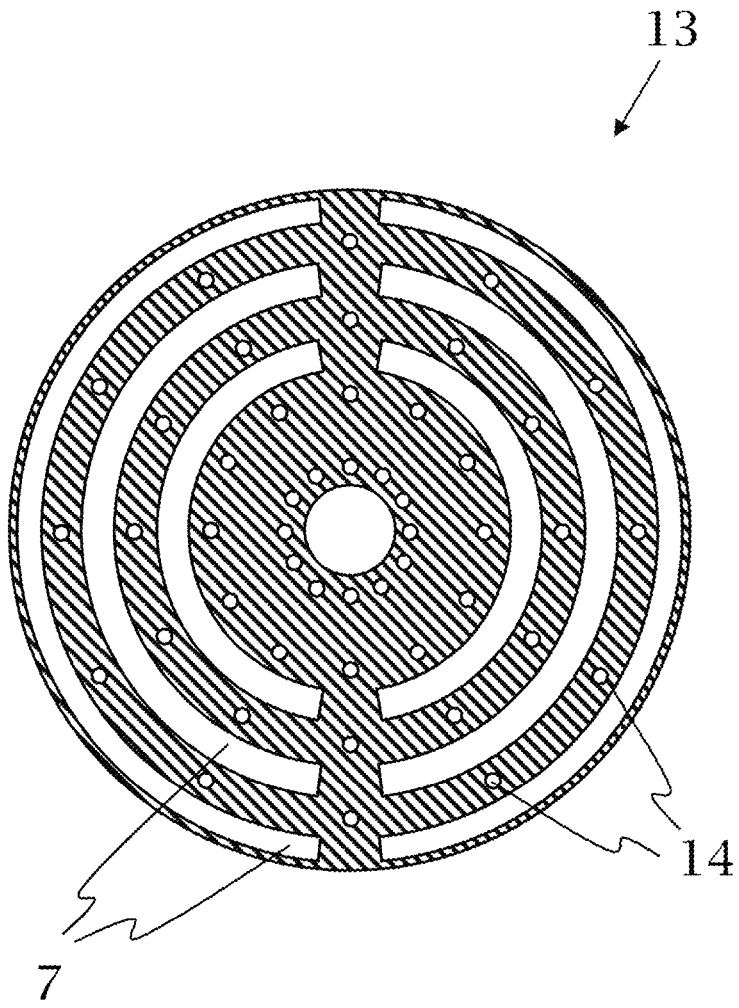
FIG. 4 is a cross-sectional view of a cover of an embodiment of a mounting according to the invention.

FIG. 4 shows the cover 13 of FIG. 2 in cross section. The cover 13 has openings 7 which correspond to the openings 7 of the disk 4. Also provided are cutouts 14 through which the electrodes 2 extend in the assembled state.

By virtue of the fact that the electrical conductor 8 is completely surrounded by an insulating material during operation, the surface area that has to be covered by a soot layer in order to enable a creepage current to form, is enlarged. The creepage length is thus increased, while at the same time a plurality of electrodes is disposed in the exhaust gas. Therefore, removal of the soot particles deposited on the mounting and on the exhaust line does not need to be performed as often.

The invention claimed is:

1. A mounting for an exhaust line, the mounting comprising:

a disk formed of an electrically insulating material, said disk having an inflow side, an outflow side and openings through which an exhaust gas can flow from said inflow side to said outflow side;

one or a plurality of electrodes extending toward said outflow side and configured to generate electric fields in the exhaust line; and at least one electrical conductor fastened at least one of on or in said disk, said electrical conductor being covered by said electrically insulating material at least at said inflow side of said disk, and said electrical conductor being in electrical contact with said one or plurality of electrodes.

2. The mounting according to claim 1, wherein said at least one electrical conductor has an elongation configured to be led through a wall of the exhaust line.

3. The mounting according to claim 1, wherein said at least one electrical conductor is fastened in at least one groove formed in said disk.

4. The mounting according to claim 1, which further comprises a connecting material fastening said at least one electrical conductor at least one of on or in said disk.

5. The mounting according to claim 1, which further comprises a cover disposed on said outflow side of said disk, said cover having cutouts formed therein for receiving said one or plurality of electrodes.

6. The mounting according to claim 1, wherein said one or plurality of electrodes and said at least one electrical conductor are connected to one another by at least one of a force-locking, a form-locking or a material connection.

7. The mounting according to claim 1, wherein said disk is pot-shaped and has an outer region projecting toward said outflow side.

8. The mounting according to claim 7, wherein said projecting outer region extends along the exhaust line beyond at least one electrode.

9. The mounting according to claim 1, wherein said disk is configured to be installed into the exhaust line in an approximately transverse configuration and substantially completely spans a cross section of the exhaust line.

10. The mounting according to claim 1, wherein said at least one electrical conductor includes at least first and second electrical conductors being electrically insulated from one another, and said one or plurality of electrodes includes a first group and a second group of electrodes each being in electrical contact with a respective one of said first and second electrical conductors.

11. In an exhaust line carrying exhaust gas from an internal combustion engine, a device for ionizing soot particles in the exhaust gas, the device comprising:

at least one mounting according to claim 1; and a particle separator disposed downstream of said at least one mounting in exhaust gas flow direction.

12. The device according to claim 11, wherein said particle separator forms a counter electrode.

* * * * *